US005569977A

United States Patent [19]

Donofrio

[11] Patent Number: 5,569,977

[45] Date of Patent: Oct. 29, 1996

[54] CATHODE RAY TUBE WITH UV-REFLECTIVE FILTER AND UV-EXCITABLE PHOSPHOR

[75] Inventor: Robert L. Donofrio, Ann Arbor, Mich.

[73] Assignee: Philips Electronics North America Corporation, New York, N.Y.

[21] Appl. No.: 207,501

[22] Filed: Mar. 8, 1994

[51] Int. Cl.[6] ..... H01J 29/10

[52] U.S. Cl. ..... 313/466; 313/474; 313/467

[58] Field of Search ..... 313/466, 474, 313/487, 467, 463

[56] References Cited

U.S. PATENT DOCUMENTS

| | | | |
|---|---|---|---|
| 4,000,436 | 12/1976 | Toryu et al. | 313/487 |
| 4,275,333 | 6/1981 | Kagami et al. | 313/495 |
| 4,354,739 | 10/1982 | Scanlon et al. | 350/311 |
| 4,424,467 | 1/1984 | Masuda et al. | 313/467 |
| 4,604,550 | 8/1986 | Van Koesveld et al. | 313/474 |
| 4,633,131 | 12/1986 | Khurgin | 313/474 |
| 4,634,926 | 1/1987 | Spruit et al. | 313/474 |
| 4,647,812 | 3/1987 | Vriens et al. | 313/474 |
| 4,683,396 | 7/1987 | Takeuchi et al. | 310/358 |
| 4,822,144 | 4/1989 | Vriens | 350/339 |
| 4,874,985 | 10/1989 | Hase et al. | 313/487 |
| 4,990,824 | 2/1991 | Vriens et al. | 313/474 |
| 5,121,030 | 6/1992 | Schott | 313/474 |
| 5,179,318 | 1/1993 | Maeda et al. | 313/474 |

OTHER PUBLICATIONS

An Introduction to Luminscent of Solids By H. W. Leverenz Dover Publications 1968, pp. 254–255; 262–265.

*Primary Examiner*—Sandra L. O'Shea
*Assistant Examiner*—Matthew J. Esserman
*Attorney, Agent, or Firm*—John C. Fox

[57] ABSTRACT

Output and/or perceived persistence of visible light from a cathode ray tube is improved by incorporating a UV-excitable phosphor into the screen, and by placing a UV-reflective filter on the inside of the display panel prior to formation of the phosphor screen, so that UV light emitted from the screen upon excitation by the tube's electron beam(s) is reflected back onto the screen to excite the further emission of visible light.

17 Claims, 3 Drawing Sheets

CATHODE RAY TUBE WITH UV-REFLECTIVE FILTER AND UV-EXCITABLE PHOSPHOR

CROSS REFERENCE TO RELATED APPLICATIONS

Simultaneously filed copending U.S. patent application Ser. No. 207,502 relates to the use of a UV-reflective filter to increase the adherence of the phosphor screen in a cathode ray tube.

BACKGROUND OF THE INVENTION

This invention relates to cathode ray tubes, and more particularly relates to such tubes employing filters.

Cathode ray tubes employing filters are known. For example, it is known that the brightness of a color television projection display can be increased by the use of multilayer interference filters in the cathode ray display tubes, under the cathodoluminescent phosphor screen. Such filters tend to concentrate the light output of the tubes in the forward direction, resulting in more light being captured by the projection lenses, and consequently increased light output of the projection system. See, for example, U.S. Pat. Nos. 4,634,926 and 4,683,398, issued to Vriens et al., and assigned to U.S. Philips Corporation.

Such color projection systems rely on three separate cathode ray display tubes, one for each of the primary colors red, blue and green, to generate three separate monochrome images, which images are then superimposed on a projection screen to result in a full color image. To be effective, each tube must have a filter whose pass band characteristics match that tube's particular emission characteristics.

In addition to color projection systems, conventional direct view televisions can benefit from increased display brightness. However, the above-described use of interference filters customized to each of the primary color-emitting tubes is not applicable to direct view color TV's, because all of the colors are generated on one tube, and because there are no projection optics. Simply increasing the electron beam current to increase tube brightness generally leads to other problems, such as defocusing of the beam, increased energy consumption, increased doming, decreased cathode life, etc.

OBJECTS AND SUMMARY OF THE INVENTION

Accordingly, it is an object of the invention to increase the visible light output of a cathode ray tube without increasing its electron beam current.

To this end, a cathode ray tube is provided with a UV-reflective filter on a surface of the tube's display panel, e.g., the inner surface under the luminescent phosphor screen, and with at least one UV-excitable phosphor in the screen, that is, a phosphor which emits visible light upon excitation by UV radiation. Thus, any UV radiation emitted by the phosphors in the screen upon excitation by the tube's electron beam(s), and reflected back onto the screen by the UV-reflective filter, is available to excite additional visible light emissions from the UV-excitable phosphor(s). This visible light is substantially transmitted by the UV filter, resulting in increased light output, and because UV-excited emissions generally persist longer than electron excited emissions, increased persistence of the tube.

In accordance with a preferred embodiment of the invention, the tube is also provided with a UV-reflective layer behind the screen, to reflect UV radiation emitted in this direction. Such layer is preferably reflective of visible light as well as UV light. An evaporated metal layer, such as the evaporated aluminum layer normally present on the back side of the screen, is suitable for this purpose. In such an arrangement, the relatively thin (for example, 18–22 microns) screen is effectively sandwiched between the front and back UV-reflective layers, so that substantially all UV radiation emitted by the screen is reflected back onto the screen, regardless of the direction in which it is emitted.

The invention is applicable to both color and monochrome CRTs, for use in television, computer and allied display applications.

BRIEF DESCRIPTION OF THE DRAWING

The invention will now be described in terms of a limited number of embodiments, as elucidated by the drawing, in which.

DESCRIPTION OF THE PREFERRED EMBODIMENTS

Figure 1:
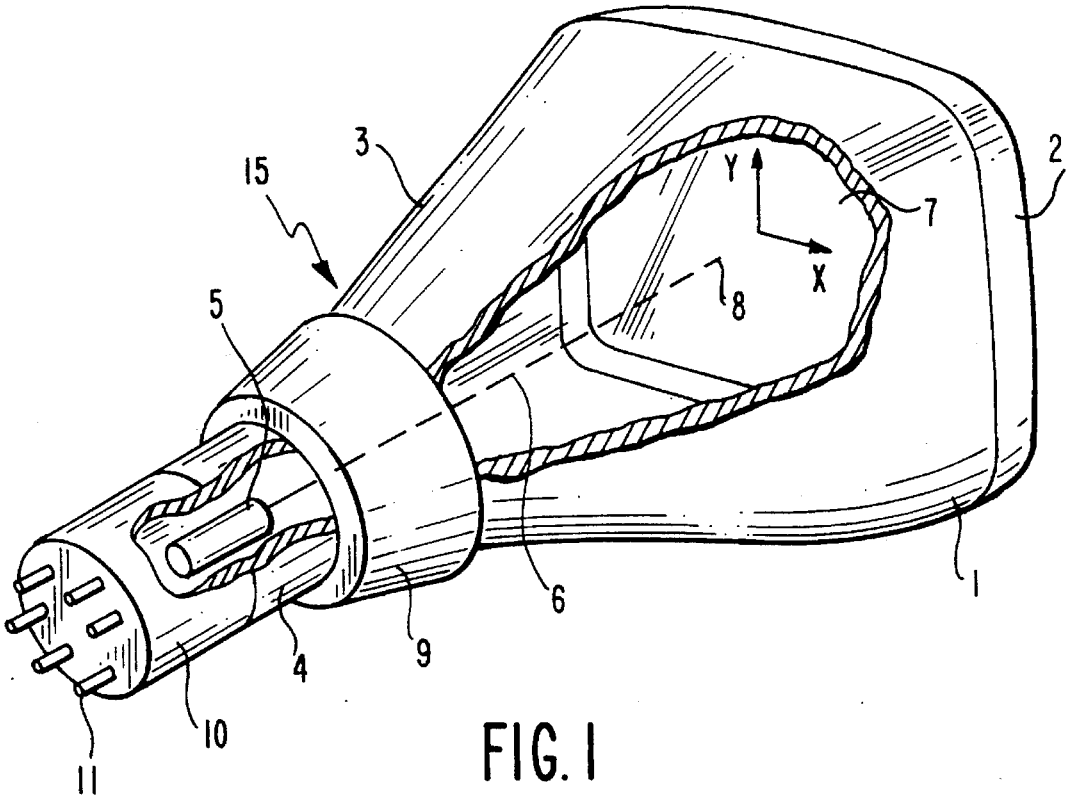
FIG. 1 is a perspective view, partly cut away, of one embodiment of a monochrome cathode ray tube of the invention, including a UV-reflective filter and a phosphor screen including a UV-excitable phosphor.

FIG. 1 is a perspective view, partly cut away, of a projection television display tube 15 according to the invention. The tube comprises a glass envelope 1, which consists of display window 2, cone 3, and neck 4, within which is an electron gun 5 for generating an electron beam 6. The electron beam is focused onto a display screen 7, provided on the inside of the display window 2 to form a spot 8. The electron beam is deflected over the display screen 7 in two mutually perpendicular directions along X, Y, axes (sometimes referred to as the major and minor axes, respectively) by means of a system of deflection coils 9. Electrical connection to the gun 5 is provided through base 10 via connection pins 11.

Figure 2:
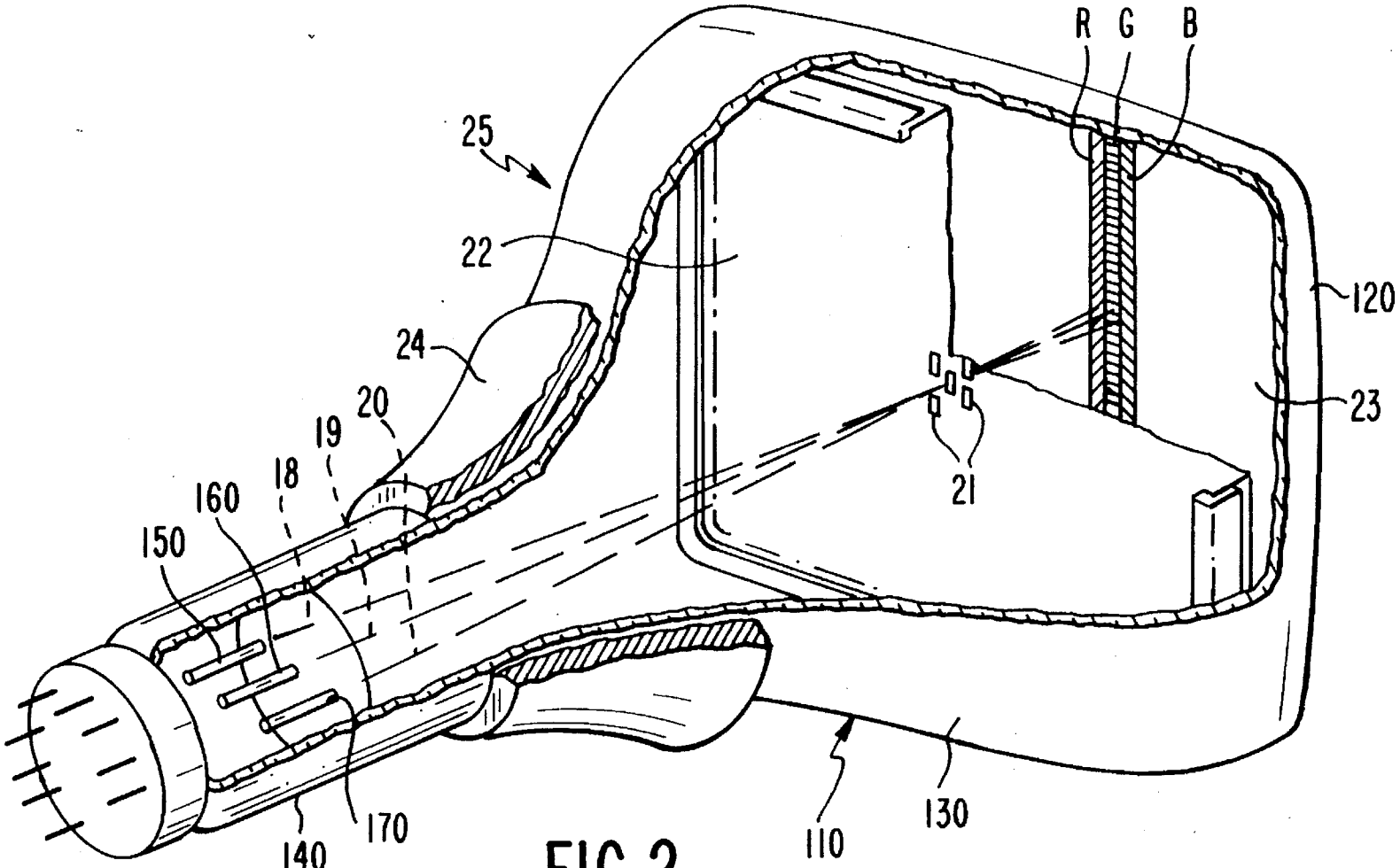
FIG. 2 is a perspective view, partly cut away, of one embodiment of a color CRT of the invention, including a UV-reflective filter and a phosphor screen including a UV-excitable phosphor.

FIG. 2 is a perspective view, partly broken away, of a color display tube of the "in-line" type. The tube 25 is composed of a glass envelope 110, consisting of a display window 120, a cone 130 and a neck 140. Three electron guns 150, 160, and 170 situated in one plane in the neck 140, generate three electron beams 18, 19 and 20. These electron beams enclose a small angle with each other, the so-called color selection angle, and pass through apertures 21 in a shadow mask or color selection electrode 22 which is adjacent to, but spaced from, the inside surface of the display window 120. A cathodoluminescent display screen 23, which consists of a large number of triplets of red, green and blue light-emitting stripe-shaped elements R, G, B, is present on the inside of the display window 120.

The convergence of the electron beams 18, 19, 20 should be such that their center axes coincide at the mask 22. The vertical rows of apertures 21 in the mask are parallel to the direction of elongation of the phosphor stripes. For each aperture 21 in the mask 22, there is an associated triplet of phosphor elements. Since the electron beams enclose a small angle with each other, the electron beam 20, when the tube is properly adjusted for color purity, impinges only on the red phosphor elements R. The electron beam 19 impinges only on the green phosphor elements G and the electron beam 18 impinges only the blue phosphor elements B.

Figure 3:
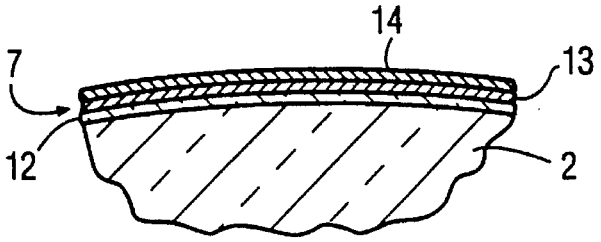
FIG. 3 and 4 are enlarged cross-sections of a portion of the display panels of the tubes of FIGS. 1 and 2, respectively, showing the UV-reflective filter, phosphor screen, and overlying aluminum layer.
Figure 4:
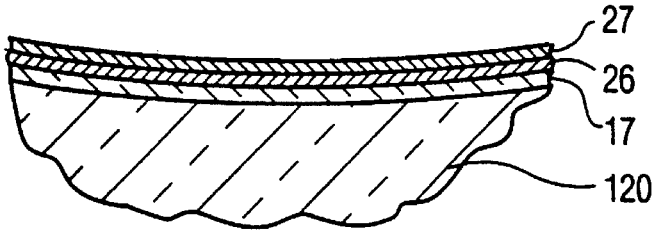

FIGS. 3 and 4 are enlarged sectional views of a portion of the display panels (2, 120) of the tubes of FIGS. 1 and 2, each showing a UV-reflective filter layer (12, 17) on the inner surface of the panel, a phosphor screen (13, 26) on the UV-reflective filter layer, and an aluminum layer (14, 27) on the phosphor screen, which functions to reflect both UV and visible light emitted by the screen, and in the case of the color tube, to provide electrical continuity between the mask and screen.

One embodiment of a UV-reflective filter suitable for use in the invention, comprises alternating layers of high and low refractive index materials, for example, $TiO_2$ as the high index layer and $SiO_2$ as the low index layer. Techniques for designing and forming such filters are well known and are described, for example, in *Thin-Film Optical Filters,* by H. A. MacLeod, MacMillan, N.Y., 1985, Adam Hilger, Ltd. A typical method of forming such a filter is by vapor deposition, although other techniques are also possible.

Figure 5:
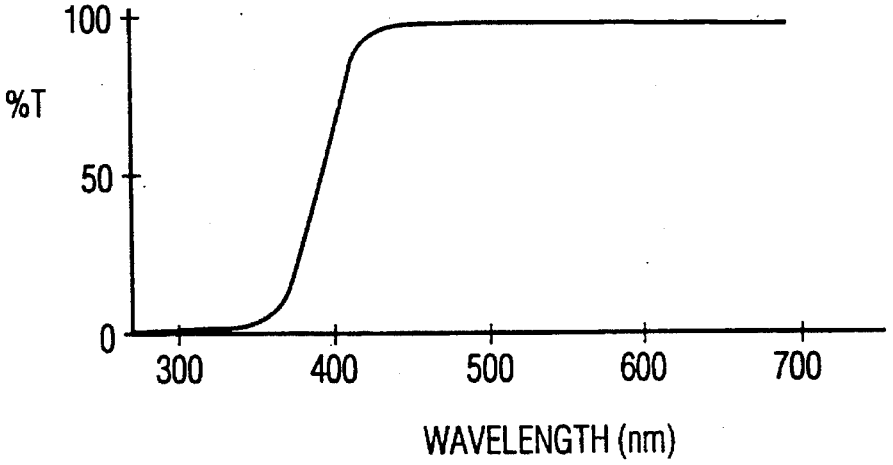
FIG. 5 is a plot of percent transmission (%T) versus wavelength (nm) of a UV-reflective filter suitable for use in the invention.

A transmission vs. wavelength characteristic of such a filter, also known as a high pass filter, having 22 layers in the pattern 0.125H, 0.25L, 0.25H, (0.25L, 0.25H)*8, 0.25L, 0.25H, 0.25L, where H is $TiO_2$, L is $SiO_2$ and the numerical coefficients indicate optical thickness, nd, where n is the refractive index and d is the physical thickness of the layer. A calculated transmission vs. wavelength characteristic of such a filter is shown in FIG. 5. As may be seen, the filter is substantially transmissive in the visible region of the light spectrum, i.e., above 400 nm, and substantially reflective in the UV region, below 400 nm.

In operation, the electron beam(s) from the gun 4 of the monochrome tube 1 or from the guns 150, 160, 170 of the color tube 100, excite the phosphor particles in the screen (13, 17) to emit visible light, which passes through filter (12, 26) and panel (2, 120) to the viewer. Any UV radiation which is emitted (in addition to visible radiation) by the phosphors as a result of stimulation by the electron beam, is reflected back to the screen to stimulate additional visible light emissions.

UV-excitable phosphors are known. See for example, An Introduction to the Luminescence of Solids, Humboldt Leverenz, Dover Publications 1968, pp 254–255; 262–265. In particular, the blue emitting ZnS:Ag phosphor used in color television picture tubes is known to luminesce in the visible region of the spectrum upon excitation by UV radiation. See curve 1 on page 254 of Leverenz. In addition, the persistence of visible light stimulated by UV is generally greater than that stimulated by electron beams. See, for example, FIG. 71 on page 264 of Leverenz.

As is also known, such a blue-emitting or other UV excitable phosphor can be used in a blend with other phosphors, e.g., the blue emitting ZnS:Ag can be blended with a yellow-emitting halophosphate, to achieve white emission.

In addition, such a blue-emitting or other UV excitable phosphor may be used in a layered screen structure, such as that found in the so-called penetron tube, in which the layers can be selectively excited by varying the energy, and thus the depth of penetration, of the electron beam(s). In either case, the UV-stimulation of visible light will result in enhanced light output and/or increased perceived persistence of the tube.

Other examples of UV-excitable phosphors useful in the invention include: Manganese activated Zinc Silicate ($Zn_2SiO_4$:Mn NBS 1028); Manganese activated Calcium Silicate ($CaSiO_3$:Pb;Mn NBS 1029); and Zns:Ag, ZnS:Cu, $Y_2O_2S$:Eu, $Y_2O_2S$:Eu;Sm, $YVO_4$:Eu, $YVO_4$:Eu;Bi.

Examples of UV emitting phosphors to be used with the UV-excitable phosphors include: Cerium activated Calcium Magnesium Silicate (P16 phosphor; emission spectrum has a max at 382 nm); Cerium activated Yttrium Silicate (P47 phosphor; emission max at about 398 nm); Titanium activated Zinc Silicate (emission max at 400 nm); Silver and Nickel activated Zinc Sulfide (emission max at 400 nm).

In addition, the UV-reflective filter may be selectively deposited on the display panel in order to render only portions of the face panel UV-reflective. Such selective application may be desirable, for example, where longer persistence is desired in only selected portions of the display, for example: to reduce flicker in the peripheral regions of the screen, where such flicker is generally more noticeable; or to allow less frequent refreshing in a certain portion (e.g., top) of the screen, and thus allow more frequent refreshing (or faster writing) in the remainder of the screen; or to represent an on-screen message or warning.

The invention has necessarily been described in terms of a limited number of embodiments. However, other embodiments and variations of embodiments will be apparent to those skilled in the art, and these are intended to be encompassed within the scope of the appended claims. For example, while the UV-reflective filter has been shown located on the inner surface of the display panel, under the screen, it may also be formed on the outer surface of the panel, where the filter may be more readily fabricated.

What is claimed is:

1. A cathode ray tube comprising;

an envelope comprising a front display panel portion, an intermediate funnel portion and a rear neck portion;

a phosphor screen on the interior surface of the display panel; and an electron gun in the neck for directing at least one electron beam to the screen;

characterized in that a UV-reflective filter is present on the display panel, and in that the phosphor screen is located between the filter and the electron gun, and comprises at least one phosphor which emits visible light upon excitation by UV radiation, and in that the filter substantially passes visible light and substantially reflects UV light, whereby upon electron excitation, the UV light emitted by the phosphor is reflected back onto the phosphor screen.

2. The cathode ray tube of claim 1 in which the UV-reflective filter comprises a multilayer interference filter.

3. The cathode ray tube of claim 2 in which the filter comprises alternating layers of materials having high and low indices of refraction.

4. The cathode ray tube of claim 3 in which the filter consists of twenty two layers.

5. The cathode ray tube of claim 4 in which the layers are in the pattern, beginning at the inner surface of the display panel: 0.125H, 0.25L, 0.25H (0.25L, 0.25H)*8, 0.25L, 0.25H, 0.25L.

6. The cathode ray tube of claim 1 in which the UV-excitable phosphor is a blue emitting phosphor.

7. The cathode ray tube of claim 6 in which the phosphor is ZnS:Ag.

8. The cathode ray tube of claim 1 in which the phosphor screen is a color screen comprising an array of phosphor elements emitting different colors of radiation.

9. The cathode ray tube of claim 1 in which the phosphor screen is a penetron screen comprising at least two separate overlying layers of different phosphors.

10. The cathode ray tube of claim 1 in which the phosphor screen comprises a blend of two or more phosphors.

11. The cathode ray tube of claim 1 in which the UV reflective filter is located on the interior surface of the face panel under the phosphor screen.

12. The cathode ray tube of claim 1 in which a UV-reflective layer is present on the display panel, located between the phosphor screen and the electron gun.

13. The cathode ray tube of claim 11 in which the phosphor screen is located on the UV-reflective filter, and a UV-reflective layer is located on the phosphor screen.

14. The cathode ray tube of claim 13 in which the UV-reflective layer also substantially reflects visible light.

15. The cathode ray tube of claim 14 in which the UV-reflective layer is an evaporated aluminum layer.

16. The cathode ray tube of claim 1 in which the UV-excitable phosphor is selected from the group consisting of $Zn_2SiO_4$:Mn; $CaSiO_3$:Pb,Mn; ZnS:Ag; ZnS:Cu; $Y_2O_2S$:Eu; $Y_2O_2S$:Eu,Sm; $YVO_4$:Eu; and $YVO_4$:Eu,Bi.

17. The cathode ray tube of claim 1 including at least one UV-emitting phosphor selected from the group consisting of Cerium activated Calcium, Magnesium Silicate; Cerium activated Yttrium Silicate; Titanium activated Zinc Silicate; and Silver and Nickel activated Zinc Sulfide.

* * * * *